United States Patent [19]

Holsinger

[11] 4,355,236

[45] Oct. 19, 1982

[54] VARIABLE STRENGTH BEAM LINE MULTIPOLE PERMANENT MAGNETS AND METHODS FOR THEIR USE

[75] Inventor: Ronald F. Holsinger, Carlisle, Mass.

[73] Assignee: New England Nuclear Corporation, Boston, Mass.

[21] Appl. No.: 143,449

[22] Filed: Apr. 24, 1980

[51] Int. Cl.[3] ..... G21K 1/08; H01J 3/14

[52] U.S. Cl. ..... 250/396 ML

[58] Field of Search ..... 250/396 R, 396 ML, 311; 313/361, 433, 442

[56] References Cited

U.S. PATENT DOCUMENTS 3,387,241 6/1968 Andoin et al. ..... 250/396 ML
3,768,054 10/1973 Neugebauer .

FOREIGN PATENT DOCUMENTS 1304893 1/1973 United Kingdom ..... 250/396 ML
662979 10/1972 U.S.S.R. .

OTHER PUBLICATIONS

"A New Generation of Samarium Colbalt Quad. Magnets for Particle Beam Focussing Applications", Holsinger et al., *Proc. Fourth Int. Workshop REC Perm. Mag. and Appl.*, (1979).

"Strong Rare Earth Colbalt Quad.", Halbach, *IEEE Trans. on Nucl. Sci.*, NS—26, pp. 3882–3884, 6/79.

"Design of Permanent Multipole Magnets with Oriented Rare Earth Colbalt Material", Halbach, *Nucl. Inst. Methal*, 169, pp. 1–10, 1980.

"The Tipless Permanent Magnet Quadrupole Lenses", Lazarev et al., 1979 *Linear Acc. Conf.*, 9/79.

"Rare Earth Permanent Magnets and Large Electrical Mach.", Parker, Third Int. Workshop REM Mag. and Appl., pp. 67–72, (6/78).

*Primary Examiner*—Bruce C. Anderson

*Attorney, Agent, or Firm*—Sewall P. Bronstein; George W. Neuner

[57] ABSTRACT

An adjustable strength multipole permanent magnet is disclosed that comprises a plurality of axial layers of magnetic material wherein one layer can be angularly displaced with respect to an adjacent layer, each of said axial layers comprising a plurality of segments comprising an oriented, anisotropic,, permanent magnet material arranged in a ring, each segment having a predetermined easy axis orientation that is preferably determined by the formula:

$$\alpha = 2\theta$$

where $\theta$ is the angle between the radial symmetry line of a segment and the X-axis and $\alpha$ is the angle between said radial line and the easy axis of the segment.

46 Claims, 7 Drawing Figures

VARIABLE STRENGTH BEAM LINE MULTIPOLE PERMANENT MAGNETS AND METHODS FOR THEIR USE

FIELD OF THE INVENTION

This invention relates multipole permanent magnets and particularly to variable strength beam line multipole permanent magnets using rare-earth cobalt materials and to methods for focusing charged particle beams using such permanent magnets.

BACKGROUND OF THE INVENTION

Multipole magnets and particularly quadrupole magnets have been found useful for a variety of applications including, for example, focusing charged particle beams. Conventionally, electromagnets have been used for such multipole configurations because of the limitations of the field strength of permanent multipole magnets and because the field strength of electric magnets could be easily varied by controlling the current density whereas the field strength of permanent magnets is fixed.

Rare earth-cobalt (REC) materials have renewed interest in permanent magnet multipoles. Most of the work has been done with respect to quadrupole magnets. For the past several years there has been considerable effort in developing permanent magnet quadrupoles for replacing electromagnets, particularly in applications such as the drift tubes in proton linacs. See, for instance, Murin et al, *Inst. Exp. Tech.*, 19 (2) (1976); and Saito et al., *Proc. Third Int. Workshop REC Perm. Mag. and Appl.*, (1978). Such designs were primarily based on replacing the coils in an electromagnet quadrupole with four suitably oriented pieces of samarium cobalt. In one such prototype permanent magnet quadrupole having an aperture radius of 1.3 cm., a pole tip field of about 3.0 Kilogauss was obtained. A method and design for reducing flux leakage in permanent magnets was described in U.S. Pat. No. 3,768,054. These previous types of permanent magnet quadrupoles apparently have limitations to about 6 Kilogauss pole tip fields using the best commercially available REC materials.

Recently a new design for permanent magnet quadrupoles was described. See Halbach, "Strong Rare Earth Cobalt Quadrupoles", LEEE Trans, Nucl. Sci., (June 1979), Holsinger et al., "A New Generation of Samarium - Cobalt Quadrupole Magnets for Particle Beam Focusing Applications", *Proc. Fourth Int. Workshop REC Perm. Mag. and Appl.*, (1979) and Halbach, "Design of Permanent Multi pole Magnets With Oriented Rare Earth Cobalt Material", *Nucl. Inst. Meth.*, 169, pp. 1–10 (1980), which are hereby incorporated by reference. The new design for REC quadrupoles allows construction of compact quadrupoles with magnet aperture fields of at least 1.2 tesla (T) with presently available materials.

The development of REC materials was begun by Strnat around 1966. Currently available materials are available as a sintered block of small, oriented, highly anisotropic crystals (composed of about one part rare earth metal and five parts cobalt) strongly magnetized in the preferred crystaline direction, conventionally called the "easy axis".

The new design comprises a ring quadrupole having a continuously varying easy axis orientation to keep all of the flux within the ring of material except for the aperture field. This theoretical ring quadrupole is approximated with a segmented ring quadrupole. For convenience of construction a 16 piece quadrupole is described by Holsinger et al. supra. This construction requires REC materials having only four different easy axis orientations.

To realize the advantages of permanent magnet quadrupoles in large aperture beam line magnets, two significant problems need to be solved: (1) the quadrupole focusing strength must be adjustable in most applications, and (2) the cost of the REC pieces must be controlled so that the total cost of the quadrupole assembly will be comparable to that of an electromagnet including the power supply.

SUMMARY OF THE INVENTION

The present invention provides an adjustable strength multipole permanent magnet, preferably a quadrupole magnet, comprising a plurality of axial layers of magnetic material wherein one layer can be angularly displaced, or rotated, with respect to an adjacent such layer, each of said axial layers comprising a plurality of segments of an oriented, anisotropic, permanent magnet material arranged in a ring so that there is a substantially continuous ring of permanent magnet material, each segment having a predetermined easy axis orientation within a plane perpendicular to the axis of the magnet.

In a preferred embodiment of the invention there is provided an adjustable strength multipole permanent magnet having means for adjusting the field strength at the aperture. The means for varying the aperture field strength moves said axial layers with respect to each other in a predetermined relationship. In one embodiment wherein an adjustable permanent quadrupole magnet comprises four axial layers as described above, the means for varying the aperture field of said quadrupole magnet comprises means for rotating the two inner layers in one direction while simultaneously rotating the two outer axial layers an equal distance in the opposite direction.

The invention further comprises a method for focusing a charged particle beam using the adjustable strength multipole permanent magnets of this invention.

DETAILED DESCRIPTION OF THE INVENTION

The invention will be described with respect to quadrupole magnets, however it will be readily appreciated by those skilled in the art that it is equally applicable to other multipole magnets, particularly higher order multipole magnets where the number of poles is an even positive integer.

In accord with the present invention, with reference to the figures, an adjustable strength permanent multipole magnet 10 comprises a plurality of segments of REC material 20 arranged in a ring so that each segment has a predetermined easy axis orientation.

Figure 2A:
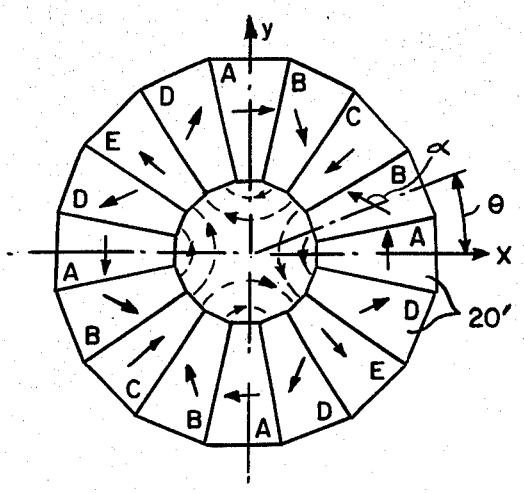
FIG. 2A illustrates a cross-section of a quadrupole consisting of 16 trapezoidal REC segments wherein the arrows indicate the easy axis orientation of each segment.
Figure 2B:
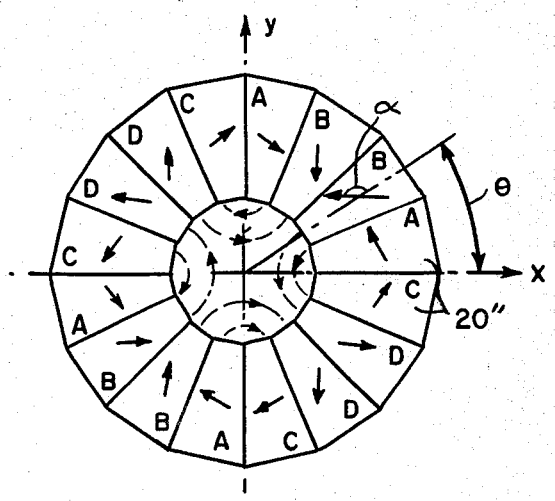
FIG. 2B illustrates another cross-section of a quadrupole consisting of 16 trapezoidal REC segments wherein the arrows indicate the easy axis orientation of each segment.

The arrows in each REC segment 20', 20'', indicate the direction of the easy axis throughout that segment. Particularly, with reference to FIGS. 2A and 2B, the radial symmetry line of a segment forms an angle $\theta$ with the x-axis and the direction of the easy axis forms an angle $\alpha$ with the symmetry line. Then for the embodiments illustrated, $$\alpha = 2\theta \tag{1}$$

For a segmented ring quadrupole with M trapezoidal pieces made of "perfect" REC material, the pole tip field is given by:

$$B_o = 2\mu_o H_c \cos\frac{2\pi}{M} \; \frac{\sin\frac{2\pi}{M}}{\frac{2\pi}{M}} \left[1 - \frac{r_i}{r_o}\right] \tag{2}$$

where $\mu_o$ is the permeability of free space, $H_c$ is the coercive magnetic force of the material, $r_i$ is the inner radius of the ring and $r_o$ is the outer radius of the ring.

For $M \rightarrow \infty$, i.e. a quadrupole with continuously varying easy axes, Equation (2) becomes:

$$B_o = 2\,\mu_o H_c \left[1 - \frac{r_i}{r_o}\right] \tag{3}$$

Two important theoretical parameters to consider for a segmented ring quadrupole are: (1) the decrease in the quadrupole strength due to the non-continuous easy axis orientation and (2) the order and magnitude of the harmonic multipole field errors introduced by the geometrical shape effects of the pieces. When $M=16$, Equation (2) gives the result that the pole tip field is reduced by only 6.3% compared to the continuous easy axis orientation.

The nth order harmonic multipole error fields which are excited in a symmetrical array of M identically shaped (not necessarily trapezoidal) and rotationally symmetric pieces are:

$$n = 2 + kM;\; k = 1, 2, 3 \tag{4}$$

i.e., for $M=16$ the first multipole error is $n=18$, the 36-pole. The magnitude of the 36-pole for the specific case of 16 trapezoidal pieces with $r_i/r_o = 1.1/3.0$ is 6.8% of the quadrupole field at 100% aperture or 0.2% at 80% aperture. This error may be eliminated by a suitable thickness shim between the trapezoidal pieces in which case the first theoretical error would be of order 34, the 68-pole.

For multipole magnets of order N, i.e. for the general case of a multiple segment 2N pole magnet, the above equations become $$\alpha = N\theta \tag{5}$$

$$B_o = \frac{N}{N-1}\,\mu_o H_c \cos^N\left(\frac{\pi}{M}\right) \frac{\sin\frac{N\pi}{M}}{\frac{N\pi}{M}} \left[1 - \left(\frac{r_i}{r_o}\right)^{N-1}\right] \tag{6}$$

$$n = N + kM;\; k = 0, 1, 2 \ldots \tag{7}$$

Although any anisotropic material can be used, rare earth cobalt and ceramic ferrite materials are preferred and samarium cobalt is particularly preferred.

Figure 1:
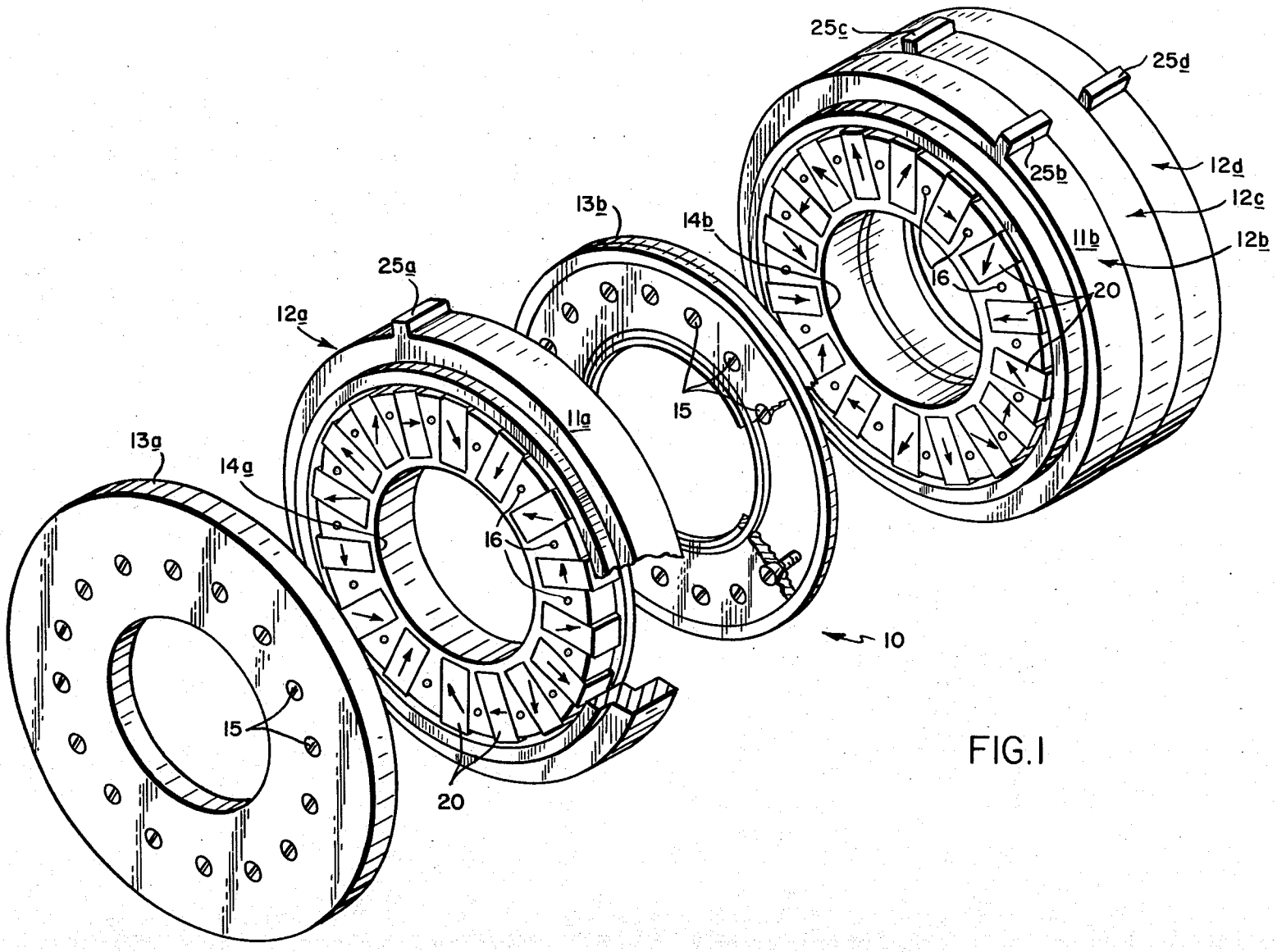
FIG. 1 illustrates a perspective view, partially exploded and partially in cross-section, of one embodiment of the invention wherein an adjustable permanent quadrupole magnet comprises four axial layers.

FIG. 1 illustrates one embodiment of the invention wherein an adjustable permanent quadrupole magnet 10 is made having four axial layers **12*a*, 12*b*, 12*c*, 12*d*. Each axial layer is a ring of sixteen rectangular-shaped segments 20 of REC material having its easy axis as illustrated by the arrows. The REC segments 20 are assembled into a circular configuration for each layer, such as 12*a*, by inserting them in ring 14*a*, which is held in annulus 11*a* by retainer ring 13*a*. Conveniently each axial layer, such as 12*a*, has a tab, such as 25*a*, for assisting angular displacement with respect to an adjacent layer, such as 12*b***.

Figure 3:
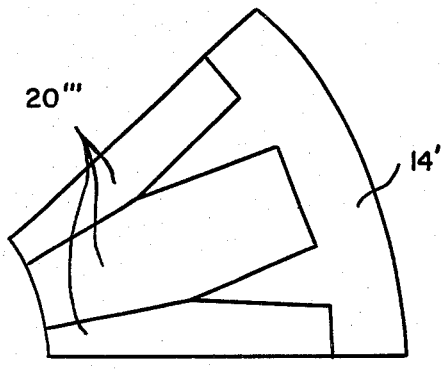
FIG. 3 illustrates an alternate embodiment of a construction for holding the REC segments to form a layer.

For convenience the shape of the individual segment magnet pieces 20'' can be modified for example as illustrated in FIG. 3, to reduce the width of the pieces and accommodate a retainer spline 14' to position the segments.

In FIG. 1 alternating axial layers are shown displaced in opposite angular directions to vary the aperture field strength. For instance layers **12*a* and 12*c* are rotatably displaced in one direction while layers 12*b* and 12*d*** are displaced relatively in the other direction. In order to reduce beam coupling effects when using the adjustable strength quadrupole of this invention, it is preferred, for a four layer quadrupole, to displace the two inner layers in one direction and the two outer layers in the opposite direction. Theorectical analysis indicates that a five layer adjustable strength quadrupole can completely eliminate coupling effects on a charged particle beam.

Quadrupoles in accord with this invention can be made, for example, from Hicorex 90B, a $SmCo_5$ compound which has nominal properties of $B_r = 8.7$ Kilogauss, $H_c = 8.2$ Kilo-oersteds, $H_{ci} > 15$ Kilo-oersteds, where $H_{ci}$ is the intrinsic coercivity, and a recoil permeability of 1.05. First a block of the $SmCo_5$ material is magnetically aligned and pressed, and then sintered. This block with approximate dimension of 2 by 2 by ½ inches has the easy axis angle aligned parallel to a 2 inch dimension and the pressing direction is parallel to the ½ inch dimension. At present this block is the largest piece of $SmCo_5$ being manufactured in large quantity. Rectangular shaped pieces (or segments when arranged in the ring to form the quadrupole) are then cut out of this block, with the cutting directions parallel, perpendicular and at 45° to the easy axis orientation so as to provide three easy axis angles. Next, the pieces are finish ground to the required dimensions and then given a further heat treatment to enhance the coercivity. Finally, the pieces are magnetized in an external field of the specified polarity. Individual blocks can also be made for each piece in the pressing, easy axis alignment, and sintering stage. In this case, the three easy axis angles are provided by rotating the die relative to the alignment magnetic field.

The final stage of manufacture is to measure the effective magnetic dipole moment per unit volume of each piece. This measurement is made with an apparatus, consisting of a Helmholtz coil pair with a mechanism for positioning and rotating the pieces in the center of the coil pair, and an integrating voltmeter connected to the coils. A magnet piece is inserted in the positioning mechanism with its easy axis parallel to the axis of the coil system, the integrator is zeroed, and then the piece is quickly rotated by 180°. The integrated induced voltage in the coil pair is proportional to the dipole strength of the piece.

This measurement also includes the effect of misalignment of the easy axis angle, since the integrated signal is also proportional to the alignment of the dipole axis with the coil axis. It would be possible to measure the easy axis angle alignment relative to the axis of the piece with this apparatus, using a modified procedure.

The significance of this data is that it provides a measure of the variation of the "strength" of the pieces due to manufacturing variables. This information gives essentially one point (open magnetic circuit) on the B-H curve, averaged over the piece.

When building permanent magnet quadrupoles it is desirable to minimize the low order harmonic errors and especially the $n=3$ sextupole error. In contrast to electromagnet quadrupoles where it is simple to provide equal excitation of each pole, the permanent magnet material variables are difficult to control and somewhat tedious to measure. Therefore, in the assembly procedure it is highly desirable to select well matched pieces in terms of "strength" for each magnet assembly. This will help assure the equal "excitation" of each pole.

FIG. 1 illustrates a four layer adjustable quadrupole of the invention where successive layers have been rotated alternately by plus and minus 22½°. The axial integral through such a multilayer quadrupole is a quadrupole field with a reduced strength proportional to the cosine of twice the rotation angle. The machanical design of such a quadrupole requires that the magnet pieces in each layer be clamped independently and that bearings be provided for precise radial and axial alignment during the rotation. The axial force between the layers must also be supported, because this force changes from maximum repulsion to maximum attraction during a plus and minus 45° rotation of two adjacent layers.

Figure 4:
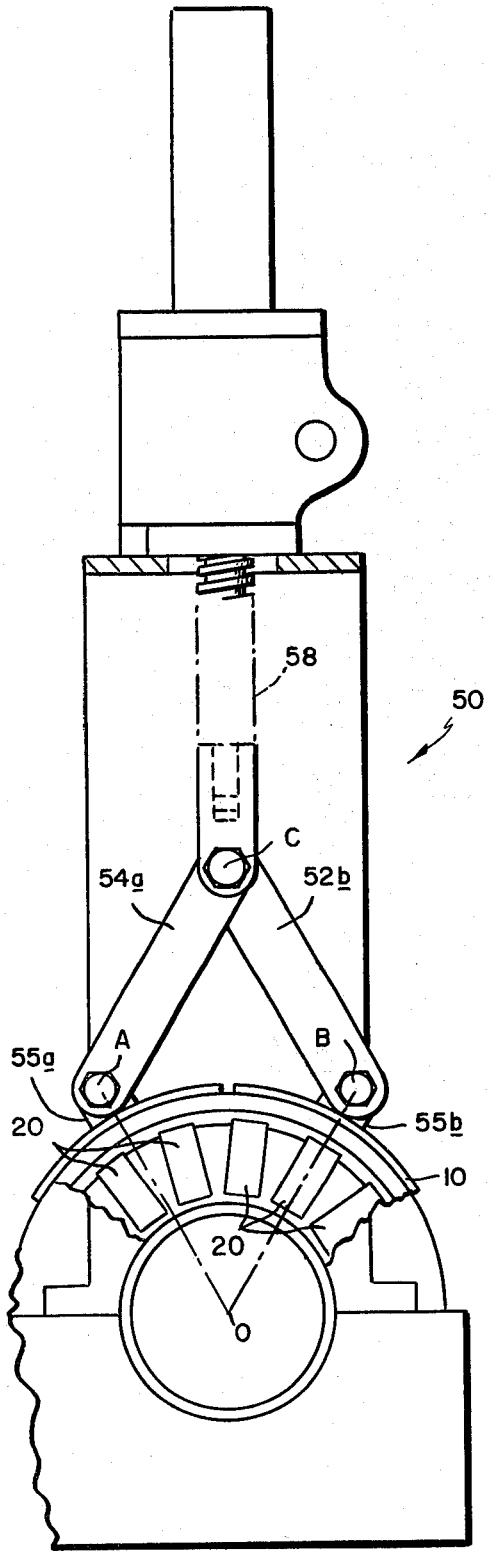
FIG. 4 illustrates an axial elevational view of an embodiment of the invention, partially in cross-section, showing a variable permanent quadrupole magnetic device.
Figure 5:
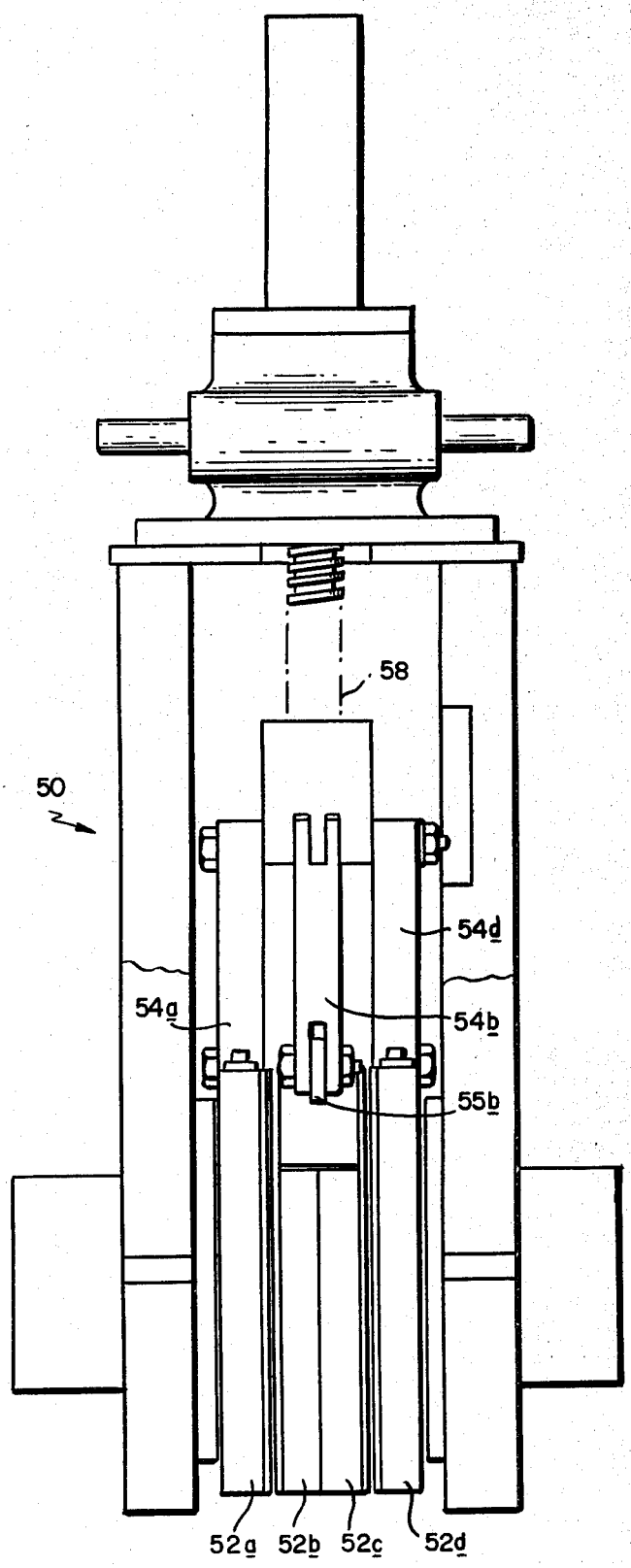
FIG. 5 is a side view of the variable quadrupole magnet of FIG. 4.

A preferred configuration consists of four ½" thick layers where the first and last layers are rotated by a positive angle and the middle two layers are rotated by the same angle in the opposite direction as illustrated in FIGS. 4 and 5. For example, in this case when the rotation angle is 20°, a 23% reduction in the integrated quadrupole strength is obtained. For this quadrupole the emittance growth has been evaluated for a typical beam and found to be less than 1%.

FIGS. 4 and 5 illustrate a preferred adjustable strength quadrupole assembly 50 in accord with the invention having adjustment means for varying the aperture field strength. The adjustment means comprises a threaded rod 58 connected to three lever arms 54*a*, 54*b* and 54*d*. A lever arm is connected to each of the outside layers, 52*a* and 52*d*, and the third lever arm is connected to the middle two layers 52*b* and 52*c*. When the rod is moved inwardly toward the quadrupole the lever arms cause the outer layers to rotate in one direction while the two inner layers rotate an equal distance in the opposite direction. This rotation causes a reduction in the aperture field strength in proportion to the distance moved by the rod. The length of arms 54 (*a*, *b* and *d*), for example the distance from pivot point A to C, is equal to the distance from the axial center 0 of the quadrupole to point A.

Figure 6:
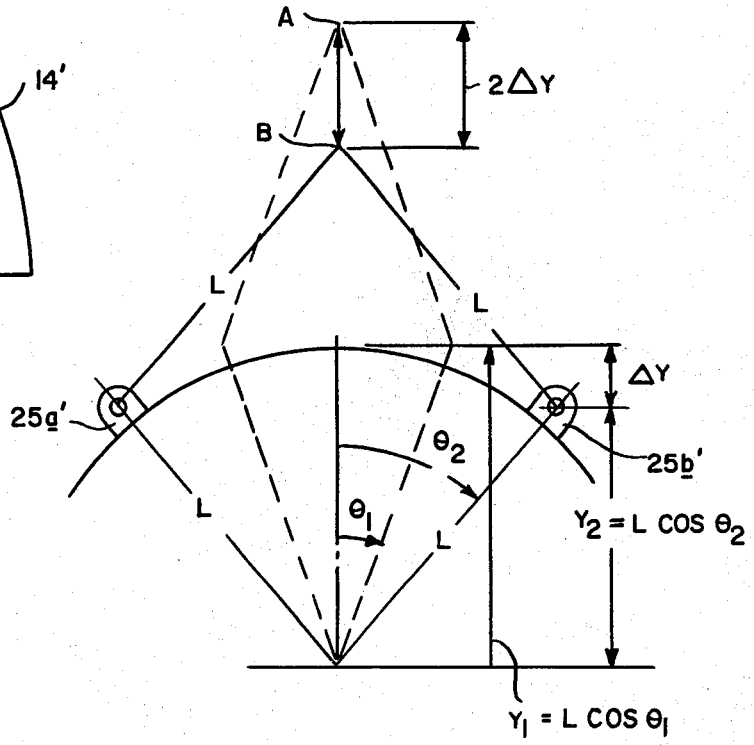
FIG. 6 is an illustration of the geometry relating to an embodiment of a variable quadrupole magnet.

The geometry of the assembly is depicted in FIG. 6 wherein the length of the arms 54 is "L". For an angular rotation $\Delta\theta=\theta_2-\theta_1$, the pivot point, 25*a'* or 25*b'*, is displaced a distance $\Delta y=y_1-y_2$ by the rod moving from A to B a distance $2\ \Delta y$. In this system both the quadrupole strength and the distance moved by the rod are proportional to $\cos\theta$. The field strength can thus be adjusted in an approximately linear manner.

The adjustable strength multipole permanent magnets of this invention are particularly useful for focusing the particle beam produced by accelerators. For example, a proton linear accelerator of the Alvarez type is conventionally designed in most respects. A machine that will accelerate protons to 45 MeV and that will produce a very high beam current of up to 5 m-amperes requires injection into the drift tube linac at 750 KeV from a Cockcroft-Walton high voltage accelerator and the accelerating electric fields in the gaps between drift tubes in the linac tank are produced by a high power radio frequency system resonating at 201 M Hz. However, instead of using electromagnet quadrupoles in the beam transport lines for beam focusing, the adjustable strength quadrupole magnets described herein are used in accord with a further aspect of this invention.

A characteristic of the quadrupoles of this invention that enables important advantages for beam transport line design. Because no space is required for a coil or cooling, the quadrupole is much more compact, for instance. This fact was used to advantage in laying out the space requirement for the focusing magnets in the beam transport lines.

Another significant advantage of focusing charged particle beams in accord with this invention is that no electrical power is required to operate the magnets. Thus economic advantages can be realized in the operation of beam transport lines.

This invention has been described in detail along with the preferred embodiments thereof. However, it will be appreciated that those skilled in the art upon reading this disclosure may make modification and improvements within this spirit and scope of the disclosure.

I claim:

1. An adjustable strength multipole permanent magnet comprising a plurality of axial layers of magnetic material wherein one layer can be angularly displaced with respect to an adjacent layer, each of said axial layers comprising a plurality of segments comprising an oriented, anisotropic permanent magnet material arranged in a ring so that there is a substantially continuous ring of permanent magnet material, each segment having a predetermined easy axis orientation within a plane perpendicular to the axis of the magnet.

2. The multipole permanent magnet of claim 1 wherein said magnetic material comprises a rare earth cobalt material.

3. The multipole permanent magnet of claim 2 wherein said rare earth cobalt material is samarium cobalt.

4. The multipole permanent magnet of claim 1 wherein said magnetic material comprises a ceramic ferrite.

5. The multipole permanent magnet of claim 1 wherein said magnet is a quadrupole magnet.

6. The quadrupole magnet of claim 5 having four axial layers.

7. The quadrupole magnet of claim 5 wherein each axial layer comprises sixteen segments.

8. The quadrupole magnet of claim 5 wherein each segment is essentially rectangular in cross-sectional shape.

9. The quadrupole magnet of claim 5 wherein the direction of the easy axis of each segment in each layer is determined by the formula:

$$\alpha=2\theta$$

where $\theta$ is the angle between the radial symmetry line of a segment and the x-axis and $\alpha$ is the angle between said radial symmetry line and the easy axis of said segment.

10. The quadrupole magnet of claim 9 further having four axial layers wherein each axial layer comprises sixteen segments and wherein said anisotropic magnetic material comprises a rare-earth cobalt material.

11. The quadrupole magnet of claim 10 wherein said rare earth cobalt material is samarium cobalt.

12. The quadrupole magnet of claim 9 further having four axial layers wherein each axial layer comprises sixteen segments and wherein said anisotropic magnetic material comprises a ceramic ferrite.

13. An adjustable strength multipole permanent magnet assembly comprising a multipole permanent magnet having a plurality of axial layers of magnetic material wherein one layer can be angularly displaced with respect to an adjacent layer and means connected to at least two adjacent axial layers for angularly displacing one layer with respect to the adjacent layer, each of said axial layers comprising a plurality of segments comprising an oriented, anisotropic, permanent magnet material arranged in a ring so that there is a substantially continuous ring of permanent magnet material, each segment having a predetermined easy axis orientation within a plane perpendicular to the axis of the magnet assembly.

14. The magnet assembly of claim 13 wherein said material comprises a rare-earth cobalt material.

15. The magnet assembly of claim 13 wherein said material comprises a ceramic ferrite.

16. The magnet assembly of claim 13 wherein said adjustable means comprises means for varying the aperture field strength to said magnet in an approximately linear manner.

17. The magnet assembly of claim 13 wherein said magnet is a quadrupole magnet.

18. The magnet assembly of claim 17 wherein the direction of the easy axis of each segment in each layer is determined by the formula:

$$\alpha=2\theta$$

where $\theta$ is the angle between the radial symmetry line of a segment and the x-axis and $\alpha$ is the angle between said radial symmetry line and the easy axis of said segment.

19. The magnet assembly of claim 17 having four axial layers wherein each axial layer comprises sixteen segments wherein said anisotropic magnetic material comprises a rare-earth cobalt material.

20. The magnet assembly of claim 19 wherein said adjustment means comprises means for rotatably displacing the two outer layers of the magnet with respect to the two inner layers of the magnet.

21. An adjustable strength multipole permanent magnet assembly comprising a multipole permanent magnet having a plurality of axial layers of magnetic material wherein one layer can be angularly displaced with respect to an adjacent layer and means connected to at least two adjacent axial layers for angularly displacing one layer with respect to the adjacent layer, each of said axial layers comprising a plurality of segments comprising an oriented, anisotropic, permanent magnet material arranged in a ring so that there is a substantially continuous ring of permanent magnet material, each segment having a predetermined easy axis orientation within a plane perpendicular to the axis of the magnet assembly, said assembly having four axial layers wherein said adjustment means comprises means for rotatably displacing the two outer layers of the magnet with respect to the two inner layers of the magnet and wherein said adjustment means further comprises a rod moveable in a direction perpendicular to the axis of the magnet, a first lever arm connected at one end to the rod and at the other end to one outer axial layer of the magnet, a second lever arm connected at one end to the rod and at the other end to the two inner axial layers of the magnet, and a third lever arm connected at one end to the rod and at the other end to the other outer axial layer of the magnet so that upon inward movement of the rod, the two other axial layers of the magnet are rotatably displaced in one direction and the two inner axial layers of the magnet are displaced angularly in the opposite direction.

22. The magnet assembly of claim 21 wherein the angular displacement of the outer layers is equal to the angular displacement of the inner layers.

23. The magnet assembly of claim 21 wherein all of said lever arms are equal in length and said length is equal to the distance from the point of attachment of the arm to the axial layer to the axial center of the quadrupole.

24. A method for focusing a charged particle beam, said method comprising focusing said charged particle beam by passing the beam through the aperture of an adjustable strength multipole permanent magnet, said magnet comprising a plurality of axial layers of magnetic material wherein one layer can be angularly displaced with respect to an adjacent layer, each of said axial layer comprising a plurality of segments comprising an oriented, anisotropic permanent magnet material arranged in a ring so that there is a substantially continuous ring of permanent magnet material, each segment having a predetermined easy axis orientation within a plane perpendicular to the axis of the magnet.

25. The method according to claim 24 wherein said magnetic material comprises a rare earth cobalt material.

26. The method according to claim 25 wherein said rare earth cobalt material is samarium cobalt.

27. The method according to claim 24 wherein said magnetic material comprises a ceramic ferrite.

28. The method according to claim 24 wherein said magnet is a quadrupole magnet.

29. The method according to claim 28 wherein said magnet comprises four axial layers.

30. The method according to claim 28 wherein each axial layer comprises sixteen segments.

31. The method according to claim 28 wherein each segment is essentially rectangular in cross-sectional shape.

32. The method according to claim 28 wherein the direction of the easy axis of each segment in each layer is determined by the formula;

$$\alpha=2\theta$$

where $\theta$ is the angle between the radial symmetry line of a segment and the x-axis and $\alpha$ is the angle between said radial symmetry line and the easy axis of said segment.

33. The method according to claim 32 wherein each axial layer comprises sixteen segments and wherein said anisotropic magnetic material comprises a rare-earth cobalt material.

34. The method according to claim 33 wherein said rare-earth cobalt material is samarium cobalt.

35. The method according to claim 32 wherein said anisotropic magnetic material comprises a ceramic ferrite.

36. A method for focusing a charged particle beam, said method comprising passing the beam through the aperture of an adjustable strength multipole permanent magnet assembly, said assembly comprising a multipole permanent magnet having a plurality of axial layers of magnetic material wherein one layer can be angularly displaced with respect to an adjacent layer and means connected to at least two adjacent axial layers for angularly displacing one layer with respect to the adjacent layer, each of said axial layers comprising a plurality of segments comprising an oriented, anisotropic, permanent magnet material arranged in a ring so that there is a substantially continuous ring of permanent magnet material, each segment having a predetermined easy axis orientation within a plane perpendicular to the axis of the magnet assembly.

37. The method in accord with claim 36 wherein said material comprises a rare-earth cobalt material.

38. The method in accord with claim 36 wherein said material comprises a ceramic ferrite.

39. The method in accord with claim 36 wherein said adjustable means comprises for varying the aperture field strength of said magnet in an approximately linear manner.

40. The method in accord with claim 36 wherein said magnet is a quadrupole magnet.

41. The method in accord with claim 40 wherein the direction of the easy axis of each segment in each layer is determined by the formula;

$$\alpha=2\theta$$

where $\theta$ is the angle between the radial symmetry line of a segment and the x-axis and $\alpha$ is the angle between said radial symmetry line and the easy axis of said segment.

42. The method in accord with claim 40 wherein each axial layer comprises sixteen segments wherein said anisotropic magnetic material comprises a rare-earth cobalt material.

43. The method in accord with claim 42 wherein said adjustment means comprises means for rotatably displacing the two inner layers of the magnet with respect to the two inner layers of the magnet.

44. The method in accord with claim 43 wherein said adjustment means further comprises a rod moveable in a direction perpendicular to the axis of the magnet, a first lever arm connected at one end to the rod and at the other end to one outer axial layer of the magnet, a second lever arm connected at one end to the rod and at the other end to the two inner axial layers of the magnet, and a third lever arm connected at one end to the rod and at the other end to the other outer axial layer of the magnet so that upon inward movement of the rod, the two other axial layers of the magnet are rotatably displaced in one direction and the two inner axial layers of the magnet are displaced angularly in the opposite direction.

45. The method in accord with claim 44 wherein the angular displacement of the outer layers is equal to the angular displacement of the inner layers.

46. The method in accord with claim 44 wherein all of said lever arms are equal in length and said length is equal to the distance from the point of attachment of the arm to the axial layer to the axial center of the quadrupole.

* * * * *

UNITED STATES PATENT AND TRADEMARK OFFICE

CERTIFICATE OF CORRECTION

PATENT NO. : 4,355,236

DATED : October 19, 1982

INVENTOR(S) : Ronald F. Holsinger

It is certified that error appears in the above-identified patent and that said Letters Patent is hereby corrected as shown below:

Col. 1, line 7, after "relates" insert ---to---;

Col. 4, line 42, change "Theorectical" to ---Theoretical---;

Col. 6, line 35, delete "that";

Claim 21, Col. 8, line 33, change "other" to ---outer---;

Claim 43, Col. 10, line 22, change "inner" to ---outer---;

Claim 44, line 33, change "other" to ---outer---;

Claim 16, Col. 7, line 53, change "to" to ---of---.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*